US009191762B1

(12) United States Patent
Matesa

(10) Patent No.: US 9,191,762 B1
(45) Date of Patent: Nov. 17, 2015

(54) ALARM DETECTION DEVICE AND METHOD

(71) Applicant: Joseph M. Matesa, Murrysville, PA (US)

(72) Inventor: Joseph M. Matesa, Murrysville, PA (US)

( * ) Notice: Subject to any disclaimer, the term of this patent is extended or adjusted under 35 U.S.C. 154(b) by 310 days.

(21) Appl. No.: 13/770,392

(22) Filed: Feb. 19, 2013

Related U.S. Application Data

(60) Provisional application No. 61/602,142, filed on Feb. 23, 2012.

(51) Int. Cl.
*H04R 29/00* (2006.01)

(52) U.S. Cl.
CPC ..... *H04R 29/00* (2013.01)

(58) Field of Classification Search
None
See application file for complete search history.

(56) References Cited

U.S. PATENT DOCUMENTS

| | | | | |
|---|---|---|---|---|
| 2,882,364 | A | 4/1959 | Warren | |
| 3,257,528 | A | 6/1966 | Mertler | |
| 3,460,124 | A | 8/1969 | Smith et al. | |
| 3,815,426 | A * | 6/1974 | Rohner | 73/488 |
| 3,947,255 | A | 3/1976 | Oliver et al. | |
| 4,172,652 | A * | 10/1979 | Stein | 396/579 |
| 4,176,578 | A * | 12/1979 | Campbell et al. | 84/115 |
| 4,514,725 | A | 4/1985 | Bristley | |
| 4,785,474 | A * | 11/1988 | Bernstein et al. | 381/56 |
| 4,811,250 | A * | 3/1989 | Steber et al. | 702/152 |
| 4,897,862 | A | 1/1990 | Nishihara et al. | |
| 4,935,952 | A | 6/1990 | Dutra | |
| 5,068,900 | A * | 11/1991 | Searcy et al. | 704/253 |
| 5,510,767 | A | 4/1996 | Smith | |
| 5,615,271 | A | 3/1997 | Stevens et al. | |
| 5,705,985 | A | 1/1998 | Studach | |
| 5,710,555 | A | 1/1998 | McConnell et al. | |
| 5,764,142 | A | 6/1998 | Anderson et al. | |
| 5,826,664 | A | 10/1998 | Richardson | |

(Continued)

FOREIGN PATENT DOCUMENTS

| | | |
|---|---|---|
| DE | 19922133 | 11/2000 |
| JP | 2006190384 | 7/2006 |

OTHER PUBLICATIONS

Robert J. Roy, "Smoke Detector Alert for the Deaf", National Institute on Deafness and Other Communication Disorders, Phase II, Final Report NIH Grant No. 2R44 DC004254-2.

(Continued)

*Primary Examiner* — Thang Tran
(74) *Attorney, Agent, or Firm* — Kevin P. Weldon

(57) ABSTRACT

An audible alarm detector is disclosed, consisting of a microphone, band-pass filter, counter and controller. The microphone converts the acoustic signal to an electrical signal for further processing. The band-pass filter removes frequencies different from the nominal frequency of a pulsed tone alarm. The counter detects the fundamental frequency of the filtered signal in sequential time intervals. The controller compares the counter's output for each time interval with the nominal count for the expected alarm frequency. The controller also compares the results from sequential time intervals against the nominal time-sequence of the anticipated, pulsed-tone alarm. A sufficiently close match results in a positive detection condition. An audible alarm detection method is also disclosed, consisting of low-pass filtering, followed by baseline-comparison, followed by counting, followed by discrimination based on counts, followed by comparison of discriminator output sequence versus the nominal sequence.

11 Claims, 4 Drawing Sheets

(56) References Cited

U.S. PATENT DOCUMENTS

| | | | |
|---|---|---|---|
| 6,119,070 | A | 9/2000 | Beneteau et al. |
| 6,133,839 | A | 10/2000 | Ellul et al. |
| 6,195,011 | B1 | 2/2001 | Winterble et al. |
| 6,240,392 | B1 | 5/2001 | Butnaru et al. |
| 6,281,809 | B1 | 8/2001 | Potter |
| 6,362,743 | B1 | 3/2002 | Tanguay et al. |
| 6,515,589 | B2 | 2/2003 | Schneider et al. |
| 6,655,047 | B2 | 12/2003 | Miller |
| 7,075,445 | B2 | 7/2006 | Booth et al. |
| 7,477,142 | B2 | 1/2009 | Albert et al. |
| 7,642,924 | B2 | 1/2010 | Andres et al. |
| 2004/0155770 | A1 | 8/2004 | Nelson et al. |
| 2005/0185799 | A1* | 8/2005 | Bertram ..... 381/67 |
| 2008/0100435 | A1 | 5/2008 | Jorgenson et al. |
| 2008/0240300 | A1 | 10/2008 | Song et al. |
| 2008/0284558 | A1 | 11/2008 | Scheiber et al. |
| 2010/0102512 | A1 | 4/2010 | Dar |
| 2010/0175898 | A1 | 7/2010 | Steinicke |
| 2010/0269574 | A1 | 10/2010 | Zeqiri |

OTHER PUBLICATIONS

Commonly Assigned U.S. Appl. No. 14/194,748, "Appliance Shut-Off Device and Method", filed Mar. 2, 2014 (Metesa).

Commonly Assigned U.S. Appl. No. 14/195,881, "Appliance Shut-Off Device", filed Mar. 4, 2014 (Metesa).

* cited by examiner

ALARM DETECTION DEVICE AND METHOD

CROSS-REFERENCE TO RELATED APPLICATION

The present application claims the benefit of U.S. Provisional Application No. 61/602,142, filed Feb. 23, 2012. The prior application is incorporated by reference herein.

BACKGROUND OF THE INVENTION

1. Field of the Invention

This invention relates to a method and apparatus for detection of an acoustic alarm signal. More specifically, a band-pass filter emphasizes the dominant frequency of an audible alarm, and a controller uses a tallying algorithm to detect the temporal pattern of the alarm.

2. Description of the Prior Art

Audible alarms are commonly used for many purposes, such as warning of dangerous conditions, indicating when some process has completed, or annunciating the need for some action or intervention. Usually, such alarms are constructed with the intent of being perceived and recognized by humans. For example, a smoke detector is intended to warn people of the potential danger of fire.

In some cases, it is desirable for a machine to react to an alarm signal, without human participation. For example, a sprinkler system may be activated automatically by the signal from a fire detector.

A straightforward approach to such direct activation is to establish a direct electrical connection between the alarm source ("detector") and the system intended to react to the detector's output. Some detectors are equipped with electrical contacts, which open or close depending on the detector's output state. These contacts may be wired to- and monitored by a separate system provided to react to the output of the detector. However, such direct connection requires special equipment or features within the detector, as well as dedicated installation of wires between the detector and the reacting system.

Therefore, it is desirable to produce a system capable of responding directly to the audible output of certain alarm systems. One application is to provide luminous- or mechanical stimuli to deaf persons in the event of a smoke detector issuing an alarm. This topic is discussed in "Smoke Detector Alarm for the Deaf", Final Report for Phase II SBIR contract under NIH grant 2R44 DC004254-2, which is included herein by reference as reference 1. Reference 1 discusses a system wherein a microphone's output is processed by a computer program including a Fast Fourier Transform (FFT) to discern the dominant frequency of a smoke alarm conforming to the specifications given in ISO 8201, which is included herein by reference as reference 2. FIG. 1 is a block diagram of the system of reference 1. Microphone 1 converts the acoustic alarm to an electrical signal which is amplified by amplifier 2. The output of amplifier 2 is fed to a high-speed analog-to-digital converter ("ADC") 3, which samples its input at a rate much higher than the highest frequency of interest, for example approximately two- to five times the nominal fundamental frequency of the alarm to be recognized. The output data from ADC 3 is fed to a computer 4, which uses a FFT algorithm to compute the frequency content of the original acoustic signal. The FFT results are further processed by a temporal-pattern recognition algorithm, to detect the presence of an alarm signature.

Implementation of the aforementioned algorithm requires high-speed analog-to-digital conversion ("ADC") as well as a fast and powerful computer to perform the FFT calculations. So, construction of a system based on the disclosed technology will be relatively expensive and un-suitable for low-end consumer applications.

Smoke detectors and other alarm-issuing equipments are available on the consumer market at low cost. However, other systems of similarly low cost, with capability of responding to these consumer alarms, are not available. What is lacking in the art, therefore, is an electronic system that is capable of reliably detecting a particular audible alarm at low cost.

SUMMARY OF THE INVENTION

The present invention discloses a device and method for detecting audible alarm signals, which consist of a single tone that is emitted in a known temporal pattern. The invention is particularly useful for detecting the alarm of smoke detectors compatible with ISO 8201, or other alarms with similarly well-known characteristics. In one embodiment, the output of a microphone is amplified and filtered by an analog, band-pass filter adjusted to pass the nominal tone of the alarm. The filtered signal is then compared with its nominal DC level to produce a two-level (binary) signal, which is used as the clock source for a counter. A low-power microcontroller operates the aforementioned counter for fixed time intervals, and by examining the counter's value at the end of each time interval it infers the dominant frequency of the binary signal. If the dominant frequency found in one interval is in reasonable proximity to the nominal frequency of the alarm tone, that interval is scored as "true." Otherwise, if the dominant frequency found in a time interval is far removed from the nominal frequency of the alarm tone, that time interval is scored as "false." The microcontroller examines the sequence of scores ("true" and "false") for the sampled time intervals and compares the sequence to the expected pattern of the nominal alarm signal specification. If the measured sequence matches the alarm's specified sequence within a pre-defined tolerance, the microcontroller asserts that the alarm has been detected and initiates further action as the application dictates.

The present invention can be implemented using very common and inexpensive hardware, such as operational amplifiers and commercial 8-bit microcontrollers. This allows the function to be achieved at low cost. Further, the criteria for scoring the frequency content of the sampling time intervals, as well as the temporal pattern of the overall alarm sequence, are adjustable as parameters in microcode. Hence, the balance of false positive- and false negative outcomes can be adjusted simply in software, as is the case with more elaborate systems such as given in reference 1.

These and other advantages and features of the present invention will be more fully understood with reference to the presently preferred embodiments thereof and to the appended drawings.

DESCRIPTION OF THE PREFERRED EMBODIMENTS

Figure 2:
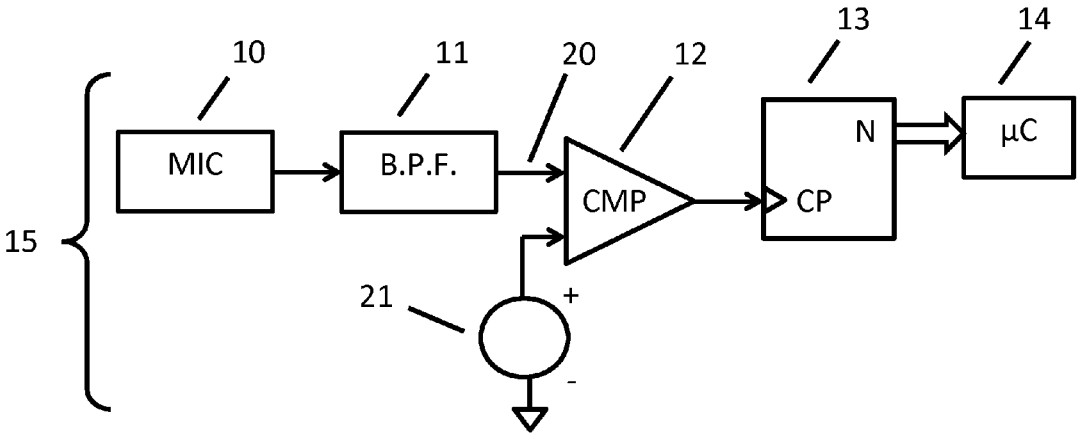
FIG. 2 is a block diagram of one embodiment of the invention.

Referring now to FIG. 2, a system 15 for recognizing an audible alarm consists of microphone 10, band-pass filter 11, comparator 12, counter 13, and microcontroller 14. Microphone 10 converts the acoustic signal into an electrical signal for further processing. Band-pass filter 11 attenuates frequencies other than the dominant, nominal frequency of the alarm signal, from the output of microphone 10. Band-pass filter 11 optionally includes amplification of the nominal frequency also, for instance in the range of 10× to 1000×. Such amplification is desirable because the output of microphone 10 is generally small, on the order of millivolts in amplitude. Comparator 12 converts the output 20 of band-pass filter 11 into a digital signal, with one level when the band-pass output 20 is more positive than a reference voltage 21 and a second level when the band-pass output 20 is more negative than reference voltage 21. Reference voltage 21 is selected to be close to the average value of band-pass output 20, so that comparator 12 will respond to relatively small signals present in the output 20 of the band-pass filter 11. However, it is preferable to select reference voltage 21 at a slightly different voltage than the quiescent (i.e. average) voltage of band-pass output 20, so as to allow for a small amount of noise on the band-pass output 20. This noise could originate in the components of band-pass filter 11, or in microphone 10, or external to the system 15, in which case the noise is introduced by acoustic coupling to microphone 10 or by electromagnetic coupling to microphone 10 or band-pass filter 11. Typically the threshold voltage 21 should be set on the order of 10 mV to 100 mV different from the nominal (quiescent) voltage of band-pass output 20.

If an alarm signal of the nominal frequency is present, the output 22 of comparator 12 will generally consist of a rectangular wave-form of the nominal frequency, due to the filtering action of band-pass filter 11. If no alarm signal is present, the output 22 of comparator 12 may take the form of a static (one-level) signal, provided the total amplitude of band-pass output 20 is sufficiently low. Or, the output 22 of comparator 12 may consist of a rectangular wave-form at the frequency of some other acoustic background that is present, such as noise from a motor, etc. Or, the output 22 of comparator 12 may consist of a rectangular wave-form with irregular timing due to the presence of multiple frequencies of sufficient amplitude in the background acoustic signal.

Figure 3:
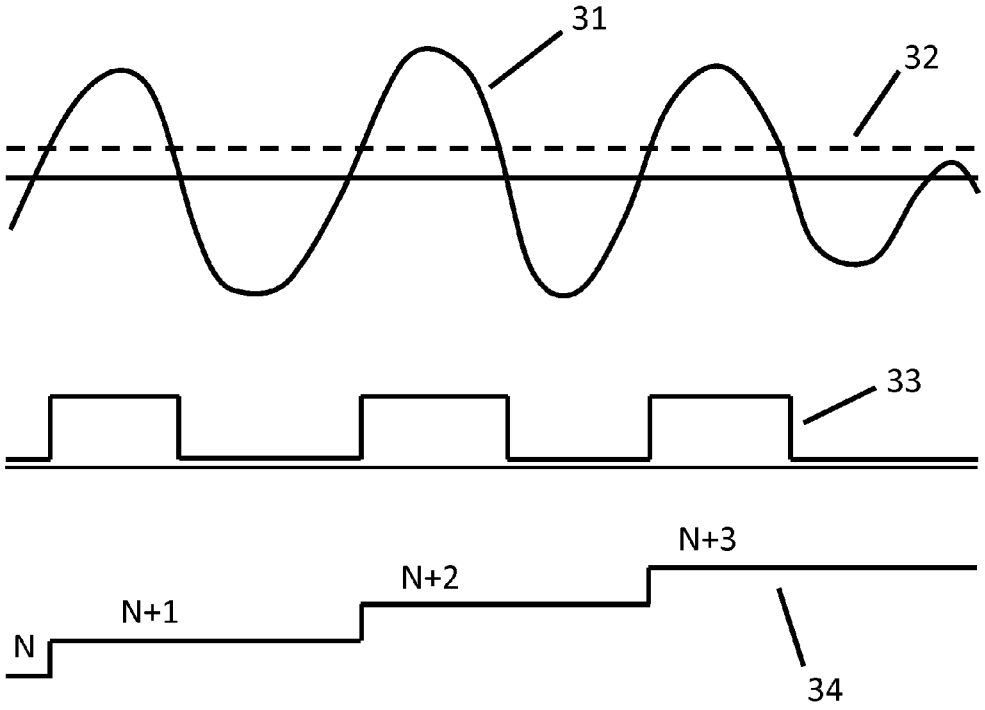
FIG. 3 is a signal-timing diagram illustrating operation of the comparator and counter of one embodiment of the invention.

Output 22 of comparator 12 is used as a clocking signal for up-counter 13. Hence, counter 13 will increment its count by one for each cycle of its input signal, which in this case is the output 22 of comparator 12. Referring to FIG. 3, wave form 31 shows an example output signal 20 from band-pass filter 11, in the traditional plot of voltage as a function of time. Wave form 32 indicates the reference voltage 21 at the reference input of comparator 12. Wave form 33 shows the output 22 of comparator 12 as a function of time, illustrating conversion of analog signal 31 to a binary (digital) form. Wave form 34 represents the output value of counter 13 as a function of time; this increments once for each rising edge of wave form 33 (i.e., comparator output 22).

Microcontroller 14 periodically reads the output count of counter 13 at regular intervals, herein referred to as "sampling intervals." By computing the difference of two successive readings of counter 13, microcontroller 14 can infer the average frequency of the comparator output 22 over the duration of time between the two readings (i.e., one sampling interval). It is desirable that the sampling interval should be long enough to include many cycles of the nominal, fundamental frequency of the alarm tone. For instance, if the sampling interval contains 10 cycles of the nominal alarm tone frequency, then there is a potential for 10% error in inferring the alarm frequency, due to mis-alignment of the edges in comparator output 22 with the sampling intervals. For this reason, the sampling frequency (i.e. the inverse of the sampling interval) should preferably be less than 1/10th of the nominal alarm tone frequency, and more preferably be less than 1/20th of the nominal alarm tone frequency.

Microcontroller 14 uses a simple comparison algorithm to judge whether the alarm tone is present. If the difference of two successive readings of the counter 13 is within a predefined tolerance of the nominal expected difference, it is assumed that the tone was present during that sampling interval. For instance, if the alarm tone is 1000 Hz, and if the sampling interval is 0.1 second, then nominally 100 counts should accumulate on the counter in each sampling interval. The microcontroller might use the criterion, for example that any count-difference between 90 and 110 counts will be treated as "tone present," or "True," and any count-difference outside of this range will be treated as "tone absent," or "False."

Figure 4:
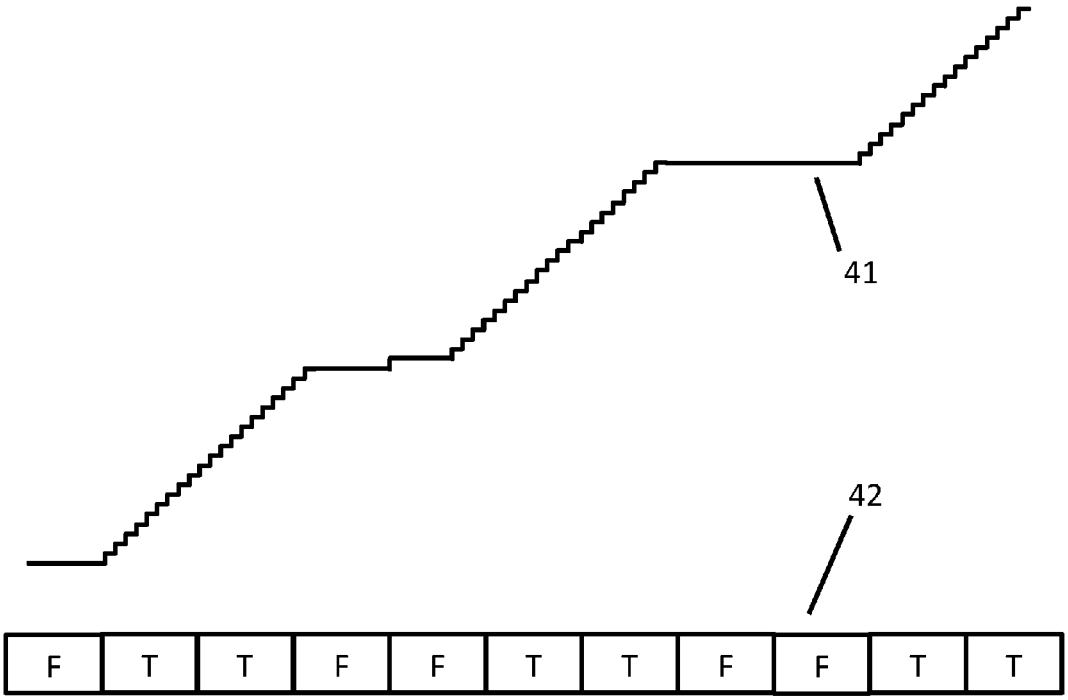
FIG. 4 is a signal-timing diagram illustrating operation of the temporal pattern recognition aspect of one embodiment of the invention.

Referring to FIG. 4, trace 41 represents an example output of counter 13 as a function of time, including three audible tone bursts. Sequence 42 represents the sequence of "True" and "False" inferences of the microcontroller as described above.

If the sampling interval is relatively short compared to the duration of on-time or off-time of the acoustic alarm, for instance less than 1/10th of the duration of an alarm tone or of the silent period between alarm tones, then most sampling intervals will either fall completely within an active-sound period, or fall completely within a silent period. For instance, if the duration of the alarm tone is more than ten times the sampling interval, then at least nine sampling intervals will occur fully within the presence of the tone. It is possible (and likely) that sampling intervals will only partially overlap the presence of a tone burst at the beginning and end of the tone burst. So, as the number of sampling intervals within a tone burst increases, the fraction of erroneous samples due to edge-effects decreases (since the number of edges is constant at two).

Increasing the number of sampling intervals per tone burst can only be accomplished by reducing the duration of a sampling interval. But previously it was noted that it is desirable for the sampling interval to contain many cycles of the nominal fundamental frequency of the alarm. Hence there is a trade-off between errors in recognizing the frequency of the alarm tone and errors in recognizing the duration of the alarm tone. A reasonable choice for this trade-off is to choose a sampling interval that is near the geometric mean of the duration of the alarm tone and the period of one cycle of the fundamental frequency of the alarm tone. This results in approximately the same relative error in detecting the frequency and detecting the duration. However, other selections of this trade-off are possible as may be recognized by those skilled in the art.

Referring again to FIG. 4, once sequence 42 is produced, it remains necessary to compare this sequence against the nominal sequence that should be produced ideally by the active alarm signal. Those skilled in the art will recognize that a straightforward way to do this is to compute the correlation of the detected sequence and the nominal sequence, and the use of this method is within the scope of the invention.

Figure 5:
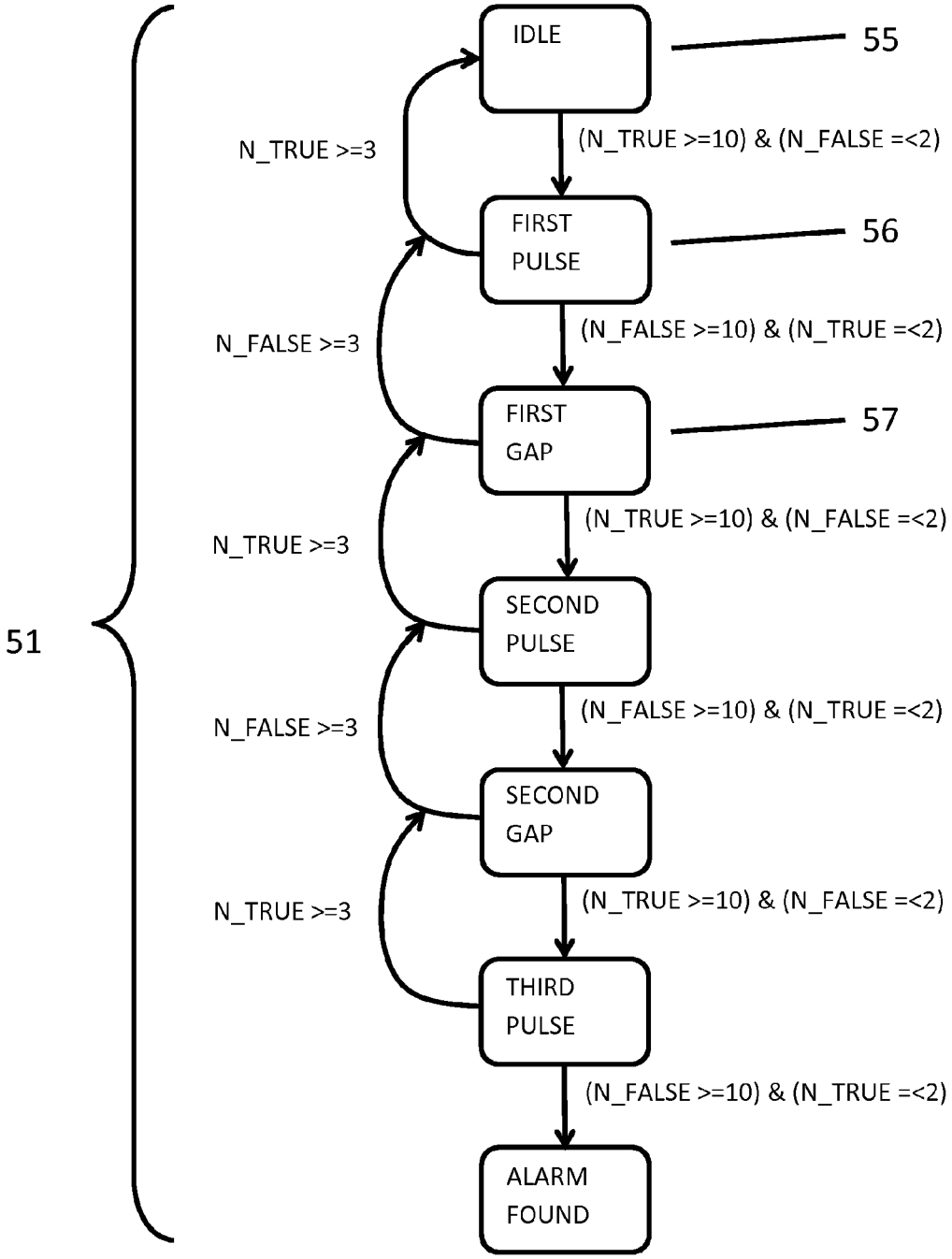
FIG. 5 is a state diagram for a temporal pattern recognition algorithm within one embodiment of the invention.

Another method to detect the temporal sequence is to detect the segments of the temporal pattern one by one, using a state machine. Referring to FIG. 5, a control algorithm 51, executed by the controller (FIG. 2, 14), begins in "idle" state 55. In idle state 55 the controller maintains tallies of the obtained "True" and "False" results of evaluations for sampling intervals. To allow for noise, errors, etc., each time a new sampling result is available the controller checks the tallies of "True" and "False" indications against pre-decided numbers of counts, to determine if a tone pulse has probably been detected. For example, a controller might require the accumulation of ten "True" results and no more than two "False" results to interpret the presence of a tone pulse. Preferably, the number of "True" results used as a criterion is somewhat smaller than the nominal number of sampling intervals that fit within a nominal tone pulse. For example, if the nominal tone pulse is 1 second wide and the sampling interval is 50 msec, a criterion of 17 "True" results and no more than three "False" results might be used to interpret the presence of a tone pulse. In FIG. 5, the criterion of at least ten "True" samples and no more than two "False" samples is shown. If the designated criteria are met, the control algorithm transitions to the next state, "First pulse" 56.

Once a tone pulse is detected, the controller (FIG. 2, 14) resets the tallies of "True" and "False" results and begins new accumulation of these tallies, to check for the expected gap between tone pulses. In this case, the control algorithm 51 moves from the "First pulse" state 56 to the "first gap" state 57 if and only if a threshold number of "False" results is obtained prior to accumulating a small number of "True" results. For example, if the nominal silent period between tone pulses is one second and the sampling interval is 50 msec, then a criterion of 17 "False" results with no more than three "True" results might be used to interpret the absence of a tone pulse. FIG. 5 shows the criterion of at least ten "False" results and no more than two "True" results for the transition to "First gap" state 57. Alternately, FIG. 5 shows that if more than two "True" results are obtained prior to detecting ten "False" results, the search for the expected pattern is abandoned and the state machine returns to "Idle" state 55 to begin a new search. The numbers used in FIG. 5 are examples only, and can readily be generalized to suit a particular application as will be recognized by those skilled in the art.

Continuing along these lines, a succession of tally criteria, matched to the expected pattern of tone pulses and gaps of silence, can be used to recognize the temporal pattern of the alarm. One of skill in the art will appreciate that this method of recognizing a temporal pattern can be implemented with very little processing power and very little memory, as compared to other methods such as the correlation function. Hence, devices of the present invention can be produced economically and therefore applied to widespread consumer applications that might not be reached by prior art methods.

Figure 1:
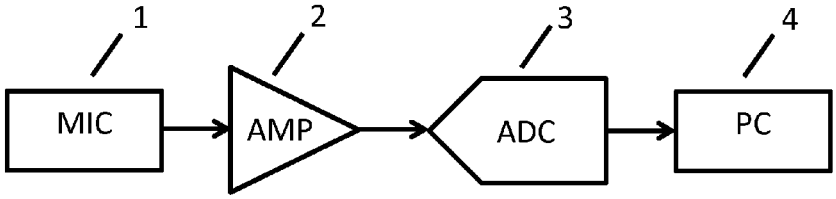
Fig. 1 Prior Art
FIG. 1 is a block diagram of a prior art detection system.

Likewise, one of skill in the art will also appreciate that the use of the band-pass filter, comparator and counter allows implementation with very inexpensive components, as compared to the relatively fast ADC 3 and PC 4 of the prior art system shown in FIG. 1.

Finally, one preferred embodiment of the invention has been described hereinabove and those of ordinary skill in the art will recognize that this embodiment may be modified and altered without departing from the central spirit and scope of the invention. Thus, the embodiment described hereinabove is to be considered in all respects as illustrative and not restrictive. The scope of the invention being indicated by the appended claims rather than the foregoing descriptions and all changes which come within the meaning and range of equivalency of the claims are intended to be embraced herein.

What is claimed is:

1. An alarm detection device comprising:
- a microphone;
- a filter that filters the output of the microphone;
- a comparator that operates on the output of the filter;
- a counter that is locked or gated by the output of the comparator; and
- a controller that samples the output of the counter at periodic intervals.

2. The alarm detection device of claim 1, wherein the counter is a microcontroller.

3. The alarm detection device of claim 1, wherein the filter is a band-pass filter.

4. The alarm detection device of claim 1, wherein the controller is a commercial microcontroller.

5. The alarm detection device of claim 4, wherein the counter is a peripheral component of a commercial microcontroller.

6. The alarm detection device of claim 4, wherein the comparator is a peripheral component of a commercial microcontroller.

7. A method for detecting an acoustic alarm comprising:
- electromechanical conversion of the acoustic signal to electrical signal;
- time-domain filtering of the signal by analog means;
- comparison of the filtered signal to a reference level close to the quiescent level of the filtered signal;
- counting of the transitions of the comparison output;
- sampling of accumulated counts from the counting step at periodic intervals;
- subtraction of successive sampled counts from the sampling step; and
- comparison of the subtraction results with a nominal pattern.

8. The method of claim 7 wherein the comparator output transitions are counted by using the comparator output as a clock signal for a counter.

9. The method of claim 7 wherein the comparator output transitions are counted by using the comparator output as an enabling gate to a counter.

10. The method of claim 7 wherein the comparison of subtraction results includes a control algorithm.

11. The method of claim 10 wherein the control algorithm changes between a pulse, gap and idle state based on tallies of affirmative and negative results of the subtraction results.

* * * * *